US007387496B2

(12) United States Patent
Chen et al.

(10) Patent No.: US 7,387,496 B2
(45) Date of Patent: Jun. 17, 2008

(54) FAN ASSEMBLY AND IMPELLER THEREOF

(75) Inventors: Te-Fu Chen, Taoyuan Hsien (TW); Tsung-Yu Lei, Taoyuan Hsien (TW); Kuo-Cheng Lin, Taoyuan Hsien (TW); Wen-Shi Huang, Taoyuan Hsien (TW)

(73) Assignee: Delta Electronics, Inc., Taoyuan Sien (TW)

( * ) Notice: Subject to any disclaimer, the term of this patent is extended or adjusted under 35 U.S.C. 154(b) by 535 days.

(21) Appl. No.: 10/827,285

(22) Filed: Apr. 20, 2004

(65) Prior Publication Data

US 2005/0169757 A1 Aug. 4, 2005

(30) Foreign Application Priority Data

Feb. 3, 2004 (TW) ..... 93102369 A

(51) Int. Cl.
*F04D 29/38* (2006.01)

(52) U.S. Cl. ..... 416/234; 416/178; 416/186 R

(58) Field of Classification Search ..... 415/185, 415/186 R, 189, 178, 234
See application file for complete search history.

(56) References Cited

U.S. PATENT DOCUMENTS

| | | | | |
|---|---|---|---|---|
| 2,253,406 | A * | 8/1941 | Wagner | 416/39 |
| 4,647,271 | A * | 3/1987 | Nagai et al. | 416/186 R |
| 5,988,979 | A * | 11/1999 | Wang | 416/178 |
| 6,514,052 | B2 * | 2/2003 | Bostwick | 417/366 |
| 6,659,724 | B2 * | 12/2003 | Takeuchi et al. | 416/185 |

FOREIGN PATENT DOCUMENTS

| | | |
|---|---|---|
| JP | 2003-035298 | 2/2003 |
| TW | 200410628 | 6/2004 |

* cited by examiner

*Primary Examiner*—Edward K. Look
*Assistant Examiner*—Devin Hanan
(74) *Attorney, Agent, or Firm*—Birch, Stewart, Kolasch & Birch, LLP

(57) ABSTRACT

A fan assembly and impeller thereof. The fan assembly includes a plurality of blades and a hub. The hub includes an upper surface and a center point. The blades have bottom portions arranged in a circle on the upper surface with respect to the center point.

2 Claims, 7 Drawing Sheets

30c

30c

FAN ASSEMBLY AND IMPELLER THEREOF

This Nonprovisional application claims priority under 35 U.S.C. § 119(a) on Patent Application No(s). 093102369 filed in Taiwan, R.O.C. on Feb. 03, 2004, the entire contents of which are hereby incorporated by reference.

BACKGROUND OF THE INVENTION

1. Field of the Invention

The present inventions relates to a fan assembly, and in particular, to a fan and an impeller thereof with higher strength and better performance.

2. Description of the Related Art

Electronic devices generally produce heat during operation, and thus, a heat-dissipating device or a fan assembly is required to dissipate the excess heat. Since the demand for heat-dissipation has increased, fans must offer optimal performance. A conventional impeller 10*a* of a fan is shown in FIG. 1A, including a plurality of blades 21 and a hub 22. The blades 21 encircle the hub 22. The hub 22 contains a motor (not shown) therein. The blades 21 are disposed in a frame 20 and connected to the hub 22 via a connecting portion 24 extending from a bottom of the hub 22. A gap 23 is formed between the hub 22 and the blades 21, above the connecting portion 24.

As shown in FIG. 1B, airflow enters the gap 23 to contact the blades 21 and flows in a direction shown by the arrows and dashed lines. Due to space limitations imposed by the other elements in the fan, a conventional way to increase the rotational speed of the motor is to increase the height H of the motor or the hub to approximately the same height as the blades 21. The motor, however, almost entirely blocks the inlet such that the airflow is unable to smoothly flow through the gap 23 between the blades 21 and the hub 22. Thus, the contact area between the airflow and the blades 21 is insufficient. Because the inlet area is reduced, the performance is also reduced. Furthermore, the conventional fan requires the gap 23, which weakens the strength of the impeller.

As mentioned above, the conventional fan needs to increase the height of the motor in order to increase power and rotational speed, but the length of the blades 21 must also be increased to increase the airflow contact area. The longer the blades 21, however, the weaker the strength of the impeller, that is, the long blades 21 are easily deformed.

Another conventional impeller 10*b* adds a rib 25 to increase the strength of the blades 21, as shown in FIGS. 2A and 2B. Each blade 21 of the impeller 10*b* is divided into upper and lower partial blades 21*a* and 21*b*. The rib 25 is disposed between the upper and lower partial blades 21*a* and 21*b* and connected to the hub 22. Thus, the blade structure can be strengthened by the rib 25. The rib 25, however, may interfere with the airflow, which must travel around the rib 25 to enter the gap 23, thus causing turbulence. Furthermore, the amount of inflow is reduced due to insufficient contact area between the airflow and the blade 21. As a result, the motor is unable to increase the rotational speed.

Hence, the above method is still unable to satisfy the demands of both structural stability and fan performance.

SUMMARY OF THE INVENTION

Therefore, an object of the present invention is to provide a fan that eliminates the shortcomings described above.

The present invention provides an impeller including a plurality of blades and a hub. The hub includes an upper surface and a center point. The blades have bottom portions arranged on the upper surface in a circle with respect to the center point.

The blades form an annular structure, having an outer diameter greater than, equal to, or less than the hub.

The hub further has a sidewall, and the bottom portion of each blade has a portion extending downward along the sidewall.

The hub and the blades are integrally formed.

Furthermore, the present invention discloses a fan assembly including a frame, a motor, a plurality of blades and a hub. The hub is disposed in the frame, and the motor is contained in the hub. The hub includes an upper surface and a center point. The blades include bottom portions, arranged on the upper surface in a circle with respect to the center point.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

First Embodiment

Figure 1A:
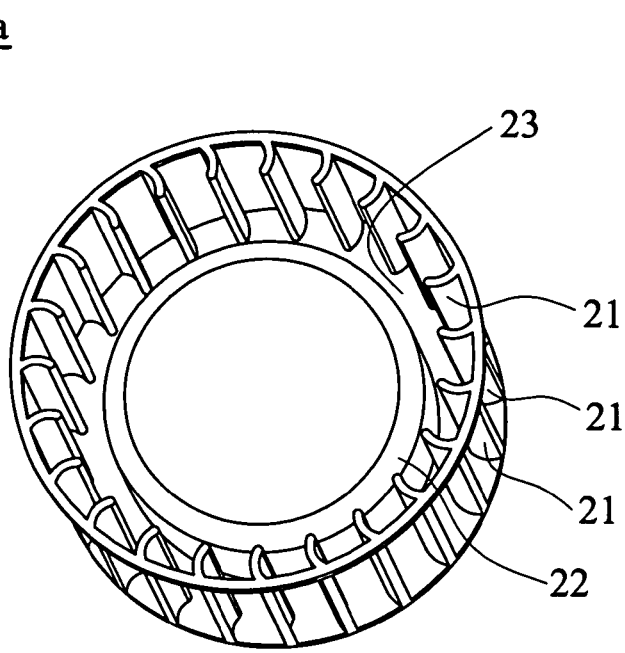
FIG. 1A (RELATED ART)
FIG. 1A is a schematic diagram of a conventional impeller.
Figure 1B:
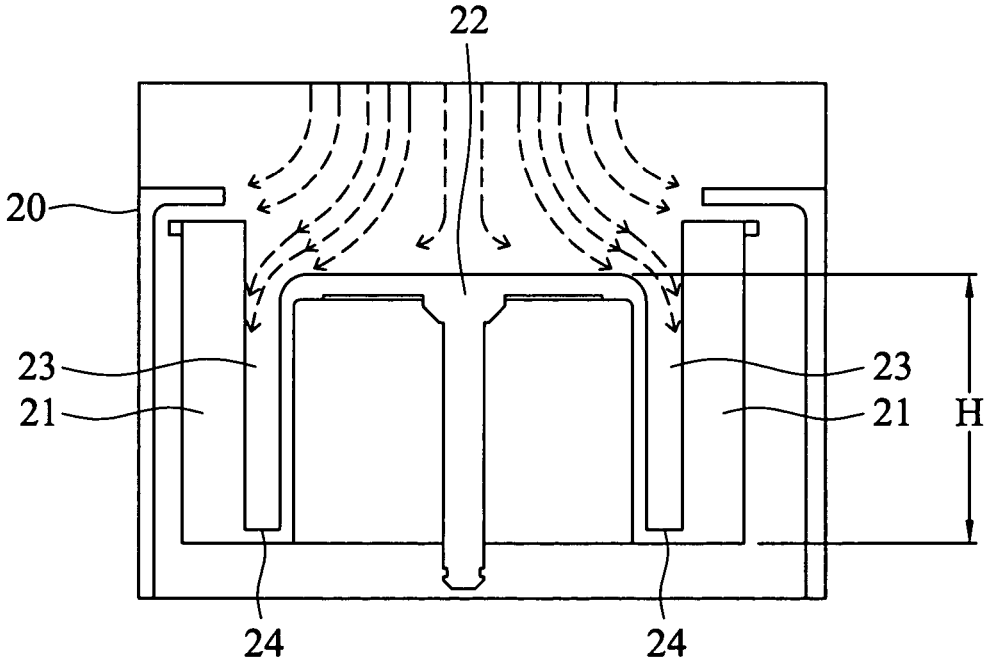
FIG. 1B (RELATED ART)
FIG. 1B is a cross section of a conventional fan.
Figure 2A:
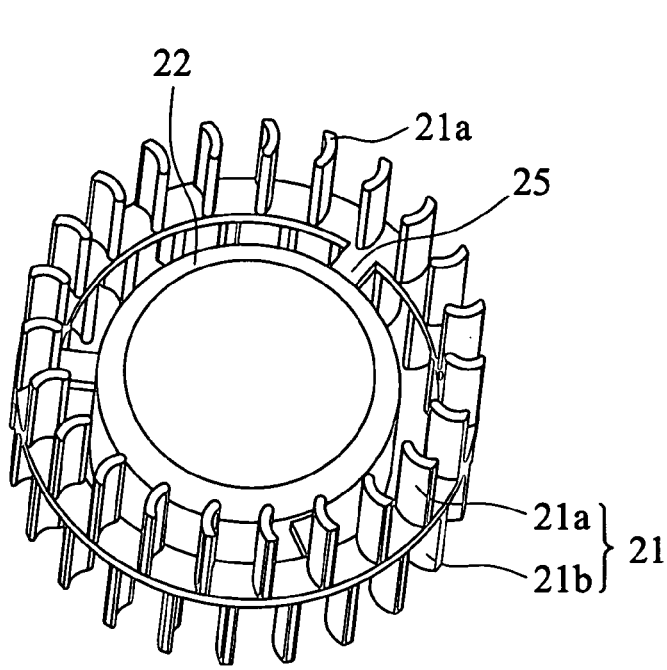
FIG. 2A (RELATED ART)
FIG. 2A is a schematic diagram of another conventional impeller.
Figure 2B:
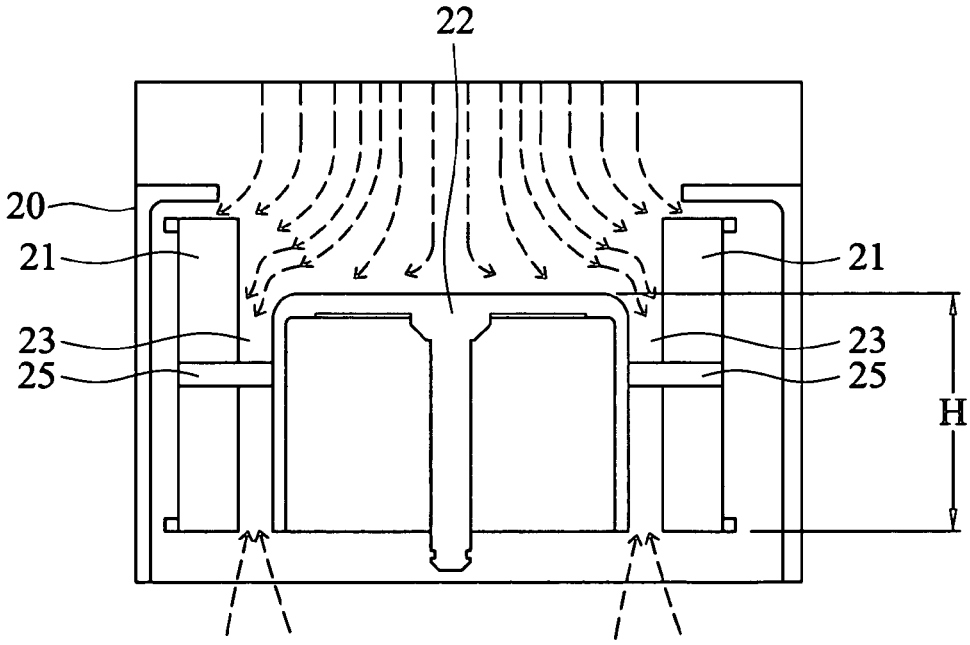
FIG. 2B (RELATED ART)
FIG. 2B is a cross section of another conventional fan.
Figure 3A:
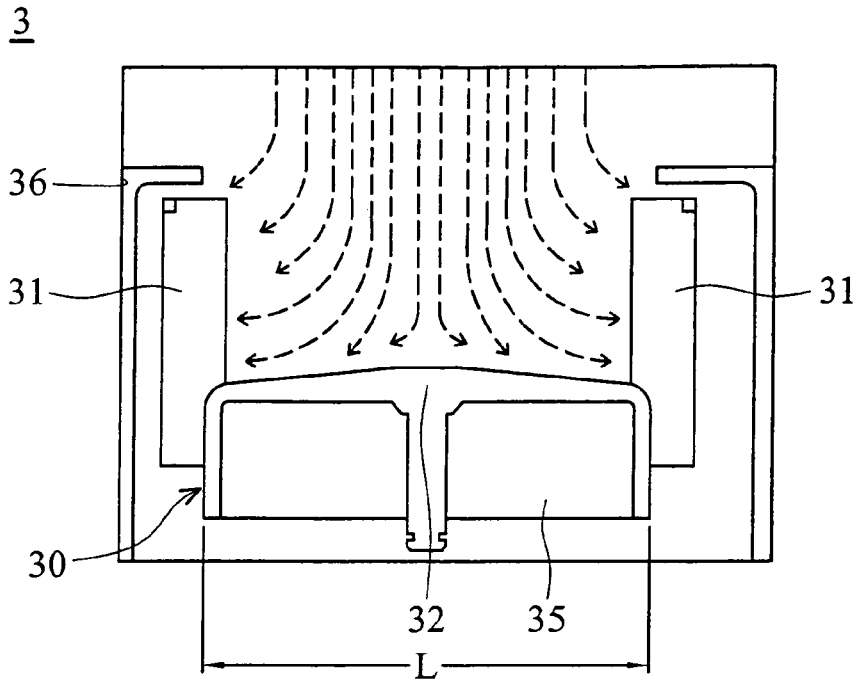
FIG. 3A is a schematic diagram of a fan assembly of a first embodiment.
Figure 3B:
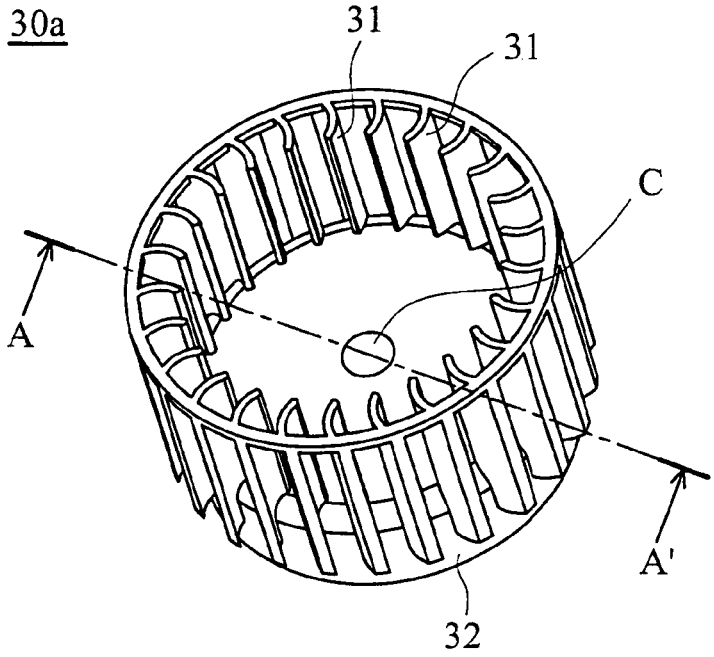
FIG. 3B is a schematic diagram of an impeller of the first embodiment.
Figure 3C:
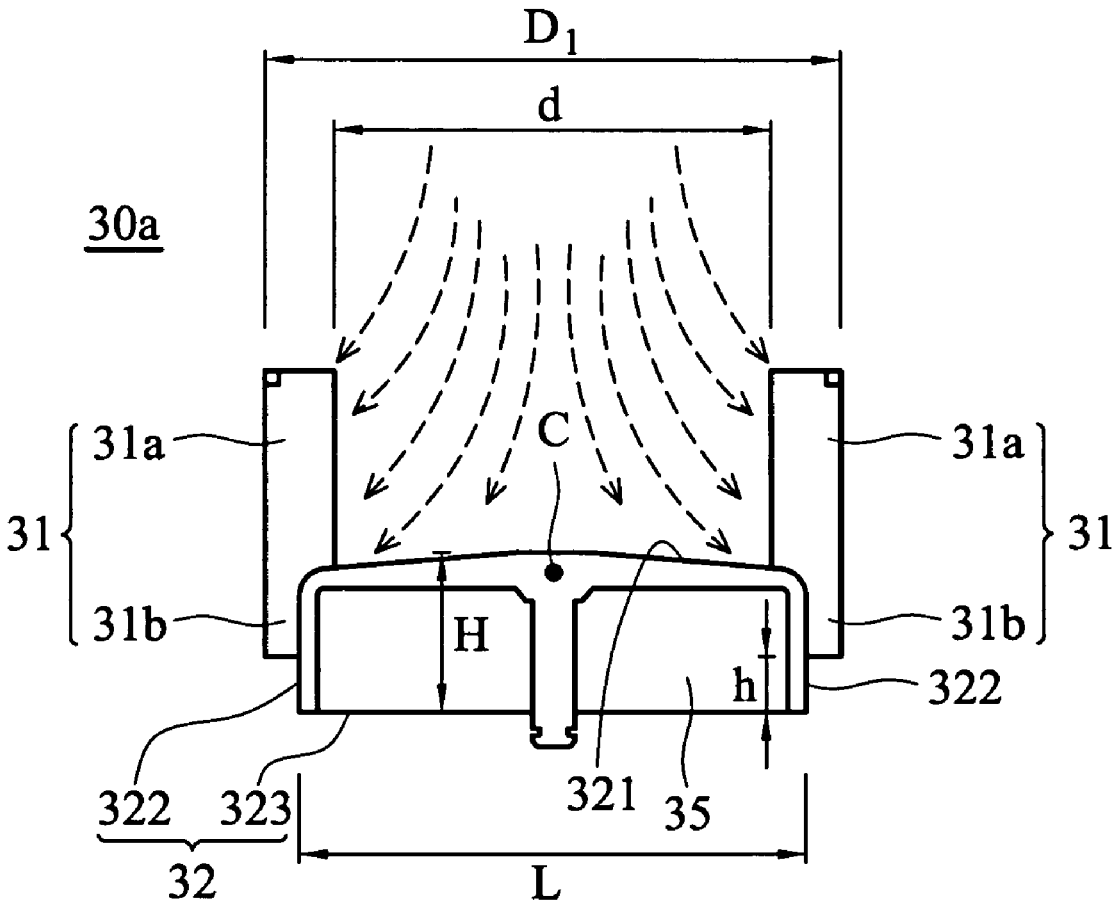
FIG. 3C is a cross section viewed along line AA' of FIG. 3B of the impeller according to the first embodiment.

FIG. 3A is a schematic diagram of a fan assembly 3 of the first embodiment. FIGS. 3B and 3C are schematic diagrams of an impeller 30 of the first embodiment. The fan assembly 3 comprises a frame 36, a motor 35, and an impeller 30. The impeller 30 is disposed in the frame 36, comprising a hub 32 and a plurality of blades 31. The motor 35 is disposed in the hub 32, as shown in FIGS. 3B and 3C. The blades 31 are arranged on the hub 32 in a circle. The blades 31 and the hub 32 can be integrally formed, and thus, there is no gap therebetween. As a result, the strength of the impeller 30 is improved to prevent blade 31 deformation and warping.

Furthermore, in the present invention, the motor 35 is redesigned to match the size of the hub in order to increase air inflow. Unlike the conventional motor with a thick and compact profile, the present invention reduces the height H of the motor 35 and increases its width. Thus, the motor 35 is wide and thin. Although the size is changed, the performance and power of the motor is preserved.

In the first embodiment, as shown in FIG. 3C, each blade 31 of the impeller 30*a* has a blade body 31*a* and a bottom portion 31*b*. The blades 31 are formed into an annular structure, having an outer diameter $D_1$. The outer diameter $D_1$ is greater than the maximum diameter L of the hub 32. In addition, the inner diameter d of the annular structure is less than the maximum diameter L of the hub 32.

The hub 32 includes a center point C, an upper surface 321, a lower surface 323, and a sidewall 322. The annular structure and the hub 32 have the same center point C. In one embodiment, a bottom portion 31*b* of each blade 31 has a portion extending downward and protruding radially along the sidewall 322 from the upper surface 32 of the hub 32. A predetermined space h is maintained between the bottom portion 31*b* of the blade 31 and the lower surface 323 of the hub 32. The extended portion of the bottom portion 31*b* increases the total length of each blade 31, thereby increasing the strength thereof.

Figure 3D:
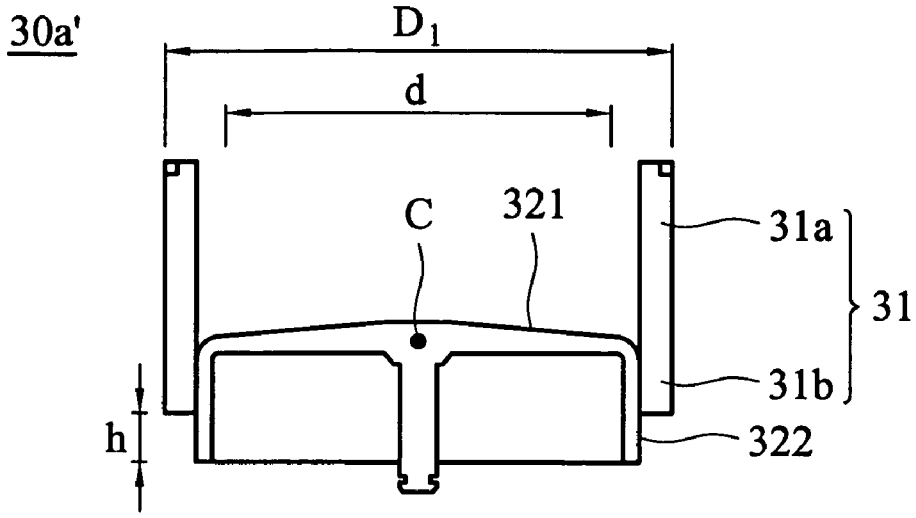
FIG. 3D is a schematic diagram of a first variation of the first embodiment.

A variation of the first embodiment is as shown in FIG. 3D. The elements common to the first embodiment are omitted. Similarly, the blades 31 of the impeller 30*a*" are formed into an annular structure with an outer diameter $D_1$ greater than the maximum diameter L of the hub 32, and an inner diameter d equal to the maximum diameter L. A bottom portion 31*b* of the blade 31 is disposed on the sidewall 322 of the hub 32. Thus, the variation can utilize a motor with a larger diameter L. Accordingly, the blades 31 are disposed on the hub 32 and extend along the sidewall 322.

Figure 3E:
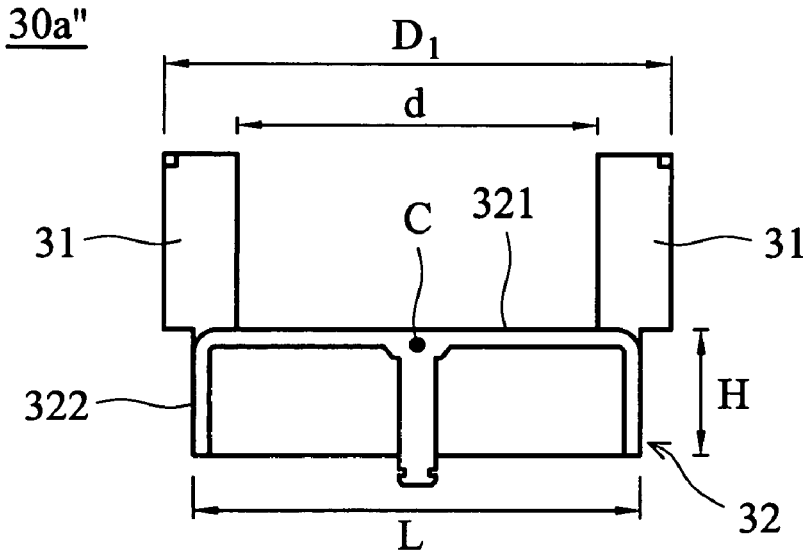
FIG. 3E is a schematic diagram of a second variation of the first embodiment.

Moreover, the first embodiment further provides a second variation, as shown in FIG. 3E. The elements common to the first embodiment are omitted. Similarly, the blades 31 of the impeller 30*a*" are formed into an annular structure with an outer diameter $D_1$ greater than the maximum diameter L of the hub 32. In this embodiment, the annular structure has an inner diameter d less than the maximum diameter L. Thus, the blades 31 are entirely disposed on the upper surface 322 of the hub 32. Furthermore, the blades 31 of the second variation of the first embodiment are wider than those of the first. Namely, compared to the first variation, the second variation may utilize a motor with smaller diameter L.

Additionally, although the size of the motor or the connection between the blades 31 and the hub 32 varies, the inlet area remains constant. Thus, the performance of the fan is greatly improved.

Second Embodiment

Figure 4A:
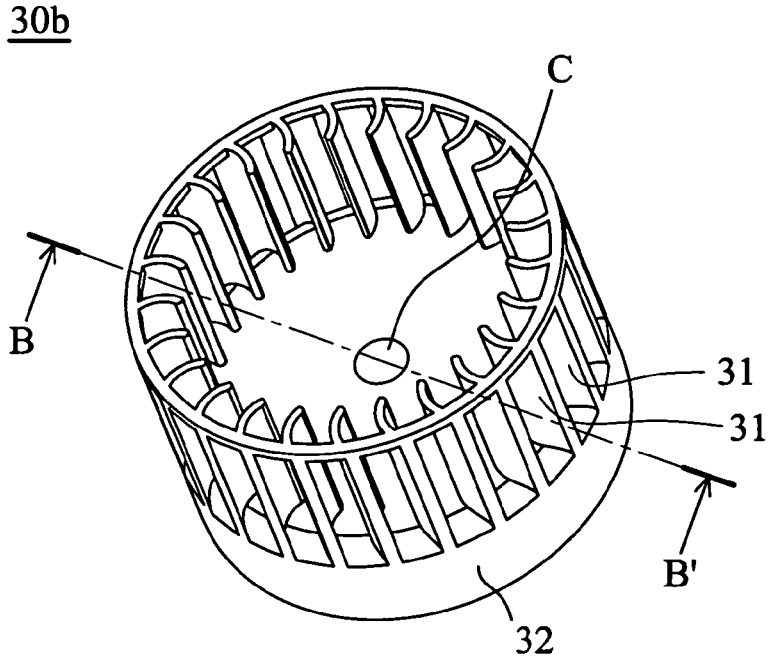
FIG. 4A is a schematic diagram of an impeller of the second embodiment.
Figure 4B:
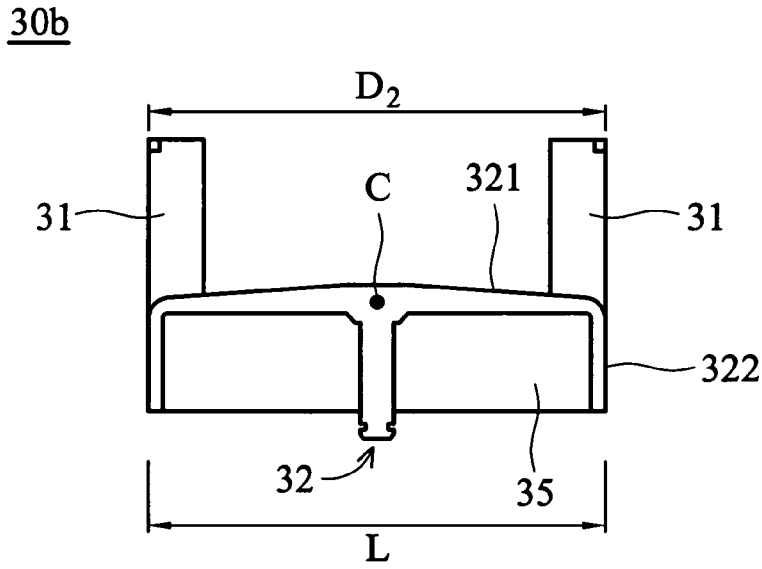
FIG. 4B is a cross section along line BB' of FIG. 4A of the impeller according to the second embodiment.

FIG. 4A is a schematic diagram of an impeller 30*b* of the second embodiment, from which elements common to the first embodiment are omitted. FIG. 4B is a cross section viewed along line BB' of FIG. 4A of the impeller 30*b*. In this embodiment, the blades 31 are formed into an annular structure with an outer diameter $D_2$ equal to the maximum diameter L of the hub 32. Thus, as shown in FIGS. 4A and 4B, each blade 31 is disposed on the upper surface 322 of the hub 32. The inlet area remains unchanged. Thus, the present invention can be utilized in a fan with a motor of any diameter L.

Third Embodiment

Figure 5:
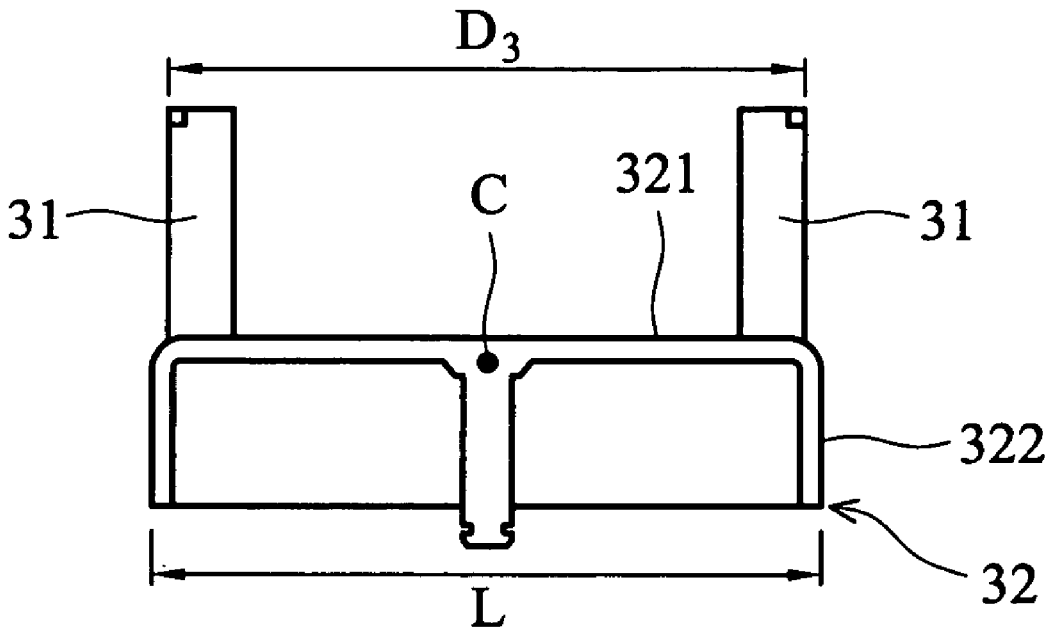
FIG. 5 is a cross section of an impeller of a third embodiment.

FIG. 5 is a cross section of an impeller 30*c* of a third embodiment, from which elements common to the first embodiment are omitted. In this embodiment, the difference is that the annular structure comprising the blades 31 has an outer diameter $D_3$ smaller than the maximum diameter of the hub 32. As shown in FIG. 5, each blade 31 is disposed on the upper surface 322 of the hub 32. The inlet area remains the same as the first embodiment, and thus, the present invention can be utilized in a fan with a motor of any diameter L.

In conclusion, the present invention has blades substantially disposed on the hub and attached thereto. No gap is formed between the blades and the hub. Instead, an open space is surrounded by the blades and above the hub. Thus, the strength of the impeller is improved without sacrificing the inlet area size. Additionally, instead of using a thick motor, a thin and wide motor with the same power and performance is used for the impeller according to the present invention. Thus, the impeller of the present invention not only has greater strength but also provides larger air inflow to increase rotational speed and provide better performance.

Finally, while the invention has been described by way of example and in terms of the preferred embodiments, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. An impeller for a fan driven by a motor, comprising:

a hub, accommodating the motor therein and having an upper surface, a sidewall and a center point; and a plurality of blades creating radial air flow and having bottom portions directly arranged in a circle on the upper surface or the side wall with respect to the center point, wherein no connecting structure is provided between the hub and the blades, wherein the blades are formed into an annular structure, having an outer diameter less than that of the hub.

2. A fan assembly, comprising:

a frame;

a motor, disposed in the frame;

a hub, disposed in the frame and containing the motor therein, having an upper surface, a sidewall and a center point; and a plurality of blades, creating radial air flow and having bottom portions directly arranged in a circle on the upper surface or the side wall with respect to the center point, wherein no connecting structure is provided between the hub and the blades, wherein the blades are formed into an annular structure, having an outer diameter less than that of the hub.

* * * * *